United States Patent [19]

Werschnik

[11] 4,430,920

[45] Feb. 14, 1984

[54] CLARINET BORE HAVING VARYING DIAMETERS

[76] Inventor: Alois Werschnik, Mädelegabelstrasse 57, 8000 München 82, Fed. Rep. of Germany

[21] Appl. No.: 217,227

[22] Filed: Dec. 17, 1980

[30] Foreign Application Priority Data

Dec. 24, 1979 [DE] Fed. Rep. of Germany ..... 2952329

[51] Int. Cl.[3] ..... G10D 7/06

[52] U.S. Cl. ..... 84/382

[58] Field of Search ..... 84/380, 382

[56] References Cited

U.S. PATENT DOCUMENTS 4,245,543 1/1981 werschnik ..... 84/382

FOREIGN PATENT DOCUMENTS 9952 of 1884 United Kingdom ..... 84/382

*Primary Examiner*—Lawrence R. Franklin

*Attorney, Agent, or Firm*—Michael N. Meller

[57] ABSTRACT

Approximately the top third of the upper body of a clarinet has an enlarged bore, the enlargement being located between two narrower zones of the bore with the result that the duodecimos and the high-register tones are correctly tuned but the construction is relatively simple.

13 Claims, 11 Drawing Figures

CLARINET BORE HAVING VARYING DIAMETERS

The invention relates to a clarinet having different diameters or volumes in the various sections of the longitudinal bore.

A clarinet of this type is shown to be known by the German Auslegeschrift No. 23 33 540, for example. While a correct pitch of the duodecimos was achieved, some difficulties remained regarding high-register tones.

This problem was substantially solved in a clarinet according to the German Auslegeschrift No. 27 16 786, in which the application of the principle described in the DE AS No. 27 16 786 for structuring the volumes of individual sections of the longitudinal bore makes possible the correct tuning of all duodecimos. It is also possible to prevent the high-pitch tones from getting too low. But this known principle requires a relatively great expenditure of effort, for it is necessary to work very precisely when forming the longitudinal bore which varies continuously within a given section. For some tone hole systems, furthermore, it may be suitable to enlarge the tone holes and/or to set them lower, so as to obtain the necessary increase in volume at given points of the longitudinal bore.

It is the purpose of the invention to provide a clarinet in which substantially all duodecimos can also be tuned correctly and in which even the notes of high pitch are tuned while requiring only a relatively small expenditure of effort during the construction of the longitudinal bore.

The solution of this problem consists in subdividing the clarinet into sections of equal length of 1 centimeter, starting with section zero at the barrel, and to provide that the longitudinal bore exhibits an enlargement in the zone between the twelfth and second sections, preferably between the tenth and second sections for B-flat clarinets and between the fourteenth and second sections for A-clarinets, the enlargement being present in at least a part of the zone and being formed by an increase of the diameter or by some other increase in volume with respect to the adjacent zone, the enlargement representing an increase of the diameter of between 4/10 mm and 20/10 mm when the prevailing tone hole pattern is retained or representing an increase in volume of between 300 $mm^3$ and 3000 $mm^3$ with possible changes in the tone holes, all relative to an imaginary cylindrical base bore. This imaginary base bore should always be considered to be a cylinder with a diameter equal to the diameter of the longitudinal bore at its narrowest point in the upper clarinet body. This imaginary base bore is solely for the purpose of providing a reference configuration with respect to which the longitudinal bore of varying diameter may be defined.

The substantial element of the invention is to be found in that an enlargement of the longitudinal bore is envisioned in at least a part of the zone ranging between sections 14 to 2, defined by the narrow zones that lie adjacent thereto both at the top and the bottom. The enlargement is preferably provided between sections 10 and 4.5. Thus, the principle consists in providing a relatively great enlargement between two relatively narrow zones, this enlargement of the bore being an improvement over the prior art in that it is sharp-angled rather than continuous, and is therefore more simply and inexpensively constructed. Of course, it is possible to provide for an enlargement over a relatively short zone, for example between the eighth and sixth sections in a B-flat clarinet and between section 12.5 and section 7.5 in an A-clarinet. The zones which lie adjacent to the enlargement at the top and the bottom may be given various shapes. For example, it is possible to provide the enlargement in a conical part of the longitudinal bore, both sides of the enlargement being conical, or a conical form may be provided only above the enlargement, i.e. in the direction of the barrel. The enlargement may be an abrupt recess, a conical enlargement or even merely a blind bore in the wall of the clarinet.

What is important is that the increase in volume is defined with respect to the imaginary, cylindrical base bore. The narrow portion of the longitudinal bore below the enlargement and extending to the twenty-second section in a B-flat clarinet and to the twenty-fourth section in an A-clarinet, beginning with the lowest point of the enlargement, may have a configuration similar to that of the base bore. This portion of the longitudinal bore is preferably cylindrical or slightly conical having a diameter decrease of 1/100 mm measured from the lowest point of the enlargement to the lowest end of the upper clarinet. This narrow portion of the longitudinal bore extending from the lowest point of the enlargement to the lowest point of the upper clarinet body may have any desired shape of known clarinets, i.e., this zone may also include further narrowings. In a B-flat clarinet, the portion of the longitudinal bore in the lower clarinet body between the twenty-second section and the point lying between the twenty-sixth and twenty-ninth sections is preferably made cylindrical and is adapted to the diameter of the aforementioned portion of the longitudinal bore in the upper clarinet body if the latter is also cylindrical from the twenty-second section up to the enlargement. If the portion of the longitudinal bore of the upper clarinet body between the twenty-second section and the lowest point of the enlargement is not cylindrical, i.e., has a varying diameter, then the portion of the longitudinal bore of the lower clarinet body located between the twenty-second section and a point lying between the twenty-sixth and the twenty-ninth sections will have a diameter equal to the diameter of the base bore. These sectional data apply to a B-flat clarinet. In an A-clarinet, this portion of the longitudinal bore of the lower clarinet body corresponds to the zone between section 24 and approximately section 31. The longitudinal bore of the lower clarinet body starting at a point lying in the sixth, seventh, or eighth section from the top of the lower clarinet body and extending toward the bell comprises a conical portion that enlarges its diameter toward the bell at a rate of 8/100 mm per section.

The simplest method of providing the increase in volume between sections 2 and 14 is by an increase of the diameter of the longitudinal bore in the given section. Depending on the length of the enlarged zone and assuming that the narrow portion of the longitudinal bore in the zone between the bottom of the enlargement and the bottom of the upper clarinet body is a cylinder with a diameter of 14.80 mm, the increases in diameter, assuming a cylindrical enlargement, may range on the order of from 4/10 to 20/10 mm, i.e., depending on whether the enlargement extends from the eighth to the third section, or, for example in a B-flat clarinet, only from the sixth to the third section. In an A-clarinet, these zones are displaced because of the greater length of the A-clarinet compared with the B-flat clarinet, as may be seen from the comparison of sectional data for the B-flat clarinet shown in FIGS. 1–6 and that for the A-clarinet shown in FIGS. 7–9. Of course, if the enlargement is short, the increase in diameter must be substantially greater to achieve the increase in volume than would be the case with a longer enlarged zone. The narrow portion of the longitudinal bore above the enlargement, i.e. in the direction of the barrel, and the bore of the barrel itself may be cylindrical and have a diameter equal to the diameter of the cylindrical bore below the enlargement. If the bore above the enlargement has a greater diameter (by 1/10 to 3/10 mm) than the bore below the enlargement, the diameter of the enlargement is not as great as when the bore above the enlargement has a diameter equal to the diameter of the bore below the enlargement.

The invention provides a simple method for constructing the clarinet because the upper clarinet body is drilled from above to the greatest size of the enlarged zone and the adjacent upper region, i.e. that lying in the direction of the barrel, is then narrowed again by means of an insert, e.g. a plastic sleeve.

The diameter enlargement may also be combined with an enlargement of the tone holes in that zone, which also creates more space. It is also possible, in addition to the steps described above, to employ the above-mentioned possibility of increasing the volume of the longitudinal bore by the disposition of radial bores that are closed off externally and thus form blind holes. The increases in diameter cited above to create the enlargement refer to clarinets in which no enlargement or lowering of the tone holes has been made in order to increase the volume of the longitudinal bore.

When the principle of the invention is applied, it may be necessary to enlarge the mouthpiece bore by 5/10 to 20/10 mm, preferably 5/10 to 8/10 mm, relative to the diameter of the base bore. In order to permit the use of a commercially available mouthpiece, it is recommended that the barrel bore of a B-flat clarinet be conically enlarged in the direction of the mouthpiece by 2/10 to 20/10 mm, preferably by 2/10 to 8/10 mm, relative to the diameter of the base bore, and that the topmost zone of the upper clarinet body of A-clarinets be enlarged beginning with section four up to the barrel. This enlargement, which may be an increase in diameter by as much as 2 mm, may also begin only with section 1.0 in an A-clarinet. The principal requirement is that, in A-clarinets, the longitudinal bore is enlarged by 8/10 to 20/10 mm relative to the diameter of the base bore, in the direction toward the barrel in the zone lying between section four and section zero if it is desired to employ a customary mouthpiece.

The diameter of the bore of the barrel depends on the enlargement in the zone between section 4 and section 0; the diameter of the barrel bore is descreased as the enlargement is made greater.

In all types of clarinets, it is recommended to displace the tone holes in the lower clarinet body downwardly by approximately 1–4 mm, in the direction of the bell.

The various changes in the position and length of the enlargement and in the diameter of the adjacent zones of the bore result in further improvements of the clean tuning of the duodecimos and the high-register tones.

Of course, the individual steps in the construction of the embodiments of the present invention are to be regarded only as approximate guidelines for the person skilled in the art and they must be further refined in dependence on the given tone hole pattern, the mouthpiece being used, the diameter and the position of the duodecimo sleeve (also known as the register key tone hole) and the type of reed, to name some factors that have an influence. For example, if a light reed is used, the diameter of the mouthpiece may be somewhat larger than when a heavy reed is used. Again, if a narrow mouthpiece is used, a longer barrel can be employed. The fine tuning of these procedures, as well as of the enlargement in sections 14 to 2 should be made on the basis of experiments because the individual steps being recited exert a mutual influence on one another and supplement each other.

For example, the enlargement envisioned for sections 14 to 2 does not necessarily have to be an abrupt recess but may be a stepped enlargement or one having a continuous increase of the diameter of the longitudinal bore if the enlared zone extends over several sections, provided only that the basic fact is realized, namely, that the indicated upper zone includes an enlargement that is very great relative to the base bore and that it has narrowed neighboring sections.

Other advantages, characteristics and details of the invention will emerge from the following description, taken together with the claims and the drawing which represents the invention in exemplary manner. In the drawing, in which the vertical axis uses a different scale than the horizontal axis, the following is shown:

Figure 10A:
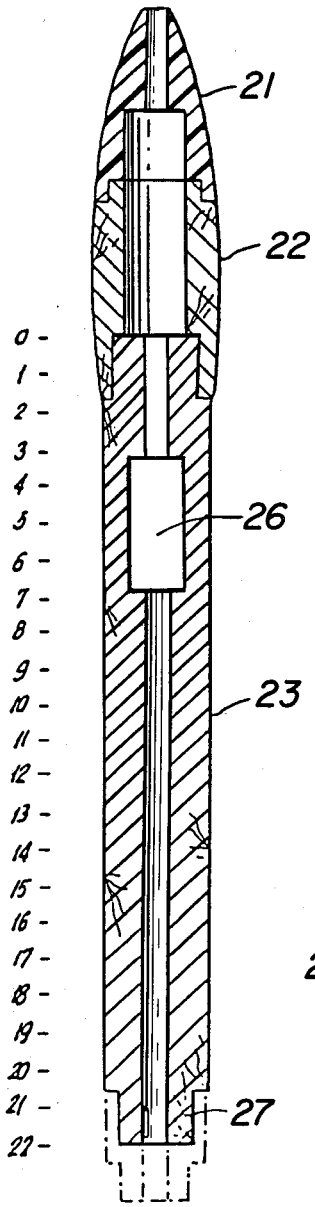
Figure 10B:
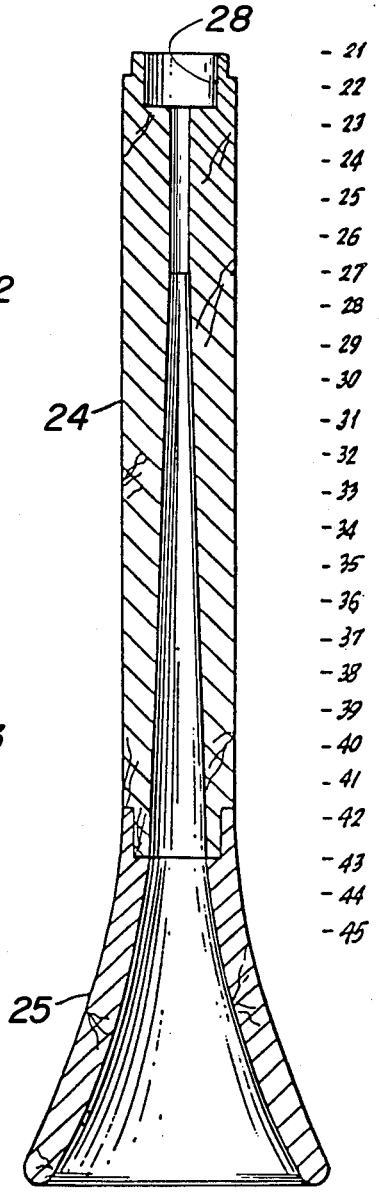

FIGS. 10*a* and 10*b* show a cross-sectional view of the partially assembled elements of the clarinet according to the present invention.

PREFERRED EMBODIMENTS

Figure 1:
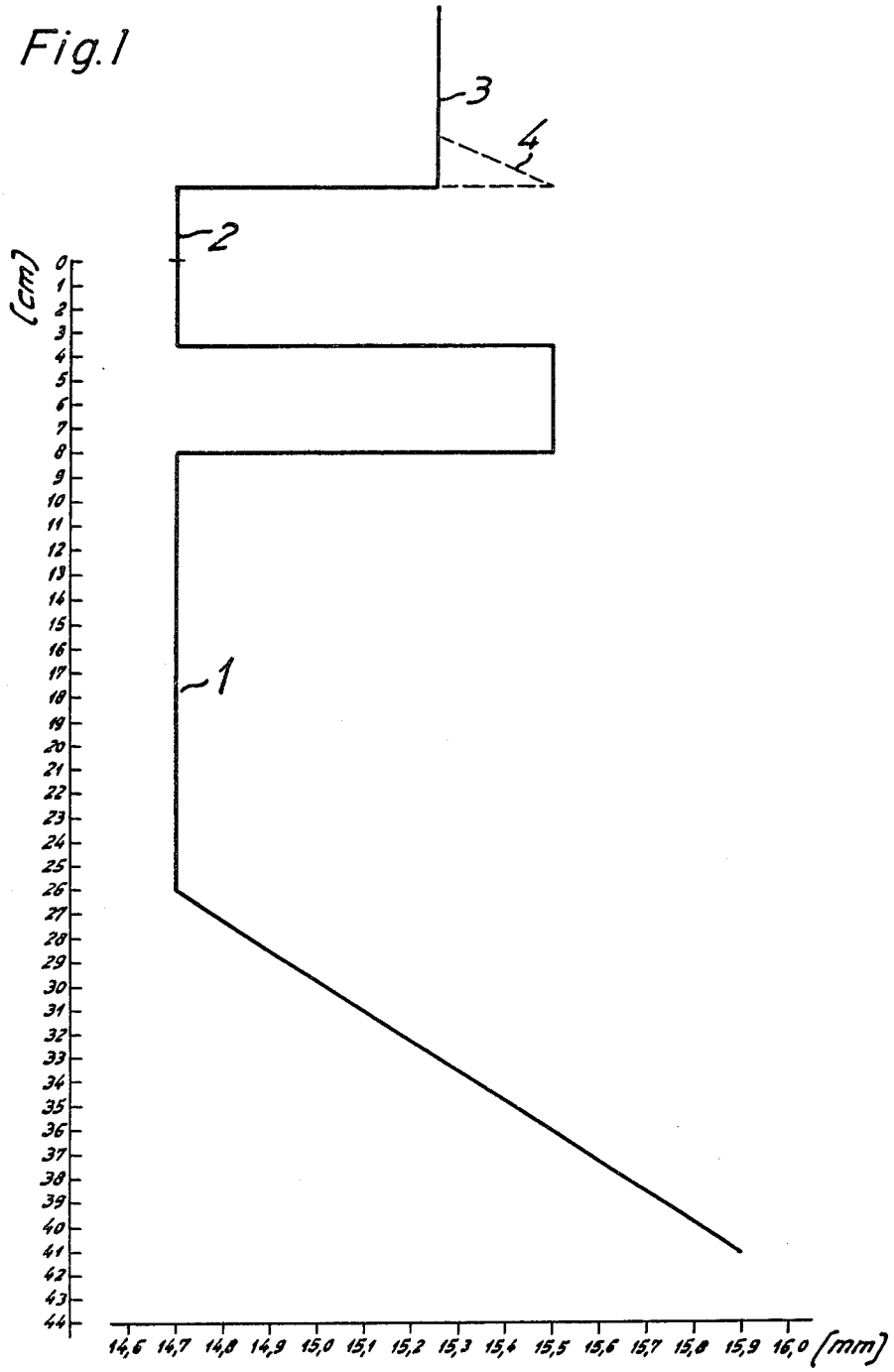
FIG. 1 shows the form of a longitudinal bore of a B-flat clarinet only the right-hand contour being illustrated.

As may be seen from FIGS. 1–10, the longitudinal bore of the clarinet body (comprising the upper and lower clarinet bodies) is divided into individual sections each having a length of 1 cm, the section 0 being disposed at the end of the upper clarinet body adjacent to the barrel. FIG. 10*a* shows the mouthpiece 21, barrel 22, and upper clarinet body 23 assembled. The longitudinal bore of the upper clarinet body 23 has an enlarged portion 26. FIG. 10*b* shows the lower clarinet body 24 and bell 25 assembled. In the fully assembled clarinet, the tenon 27 of the upper clarinet body 23 is fit snugly into the mortise 28 of the lower clarinet body 24. The narrowest portion of the longitudinal bore is located in the zone comprising the sections 8–26. In the exemplary embodiment illustrated in FIG. 1, this portion of the longitudinal bore is cylindrical, has a diameter of 14.70 mm, and is in fact the base bore (because the diameter of the bore of the upper clarinet body is everywhere greater than or equal to this diameter). Between sections 8 and section 3.5, there is provided a very great enlargement, relative to the base bore, having a diameter of 15.50 mm. Referring to FIG. 1, adjacent to the upper clarinet body bore 1 lies the barrel bore 2 which has the same diameter as the upper clarinet body bore in the zone between section 3.5 and section 0; this diameter is the same as the base bore diameter and is equal to 14.70 mm. Adjacent to the barrel bore 2 lies the mouthpiece bore 3 with a diameter of 15.25 mm. A Vandoren mouthpiece with a No. 45 face was used with the clarinet illustrated in FIG. 1. When a light reed was used, the mouthpiece was enlarged additionally toward the barrel to a diameter of 15.50 mm, as suggested by the dashed line 4. For the dimensions given, the length of the barrel was tuned to make the basic tuning of a' 440 cycles.

Figure 2:
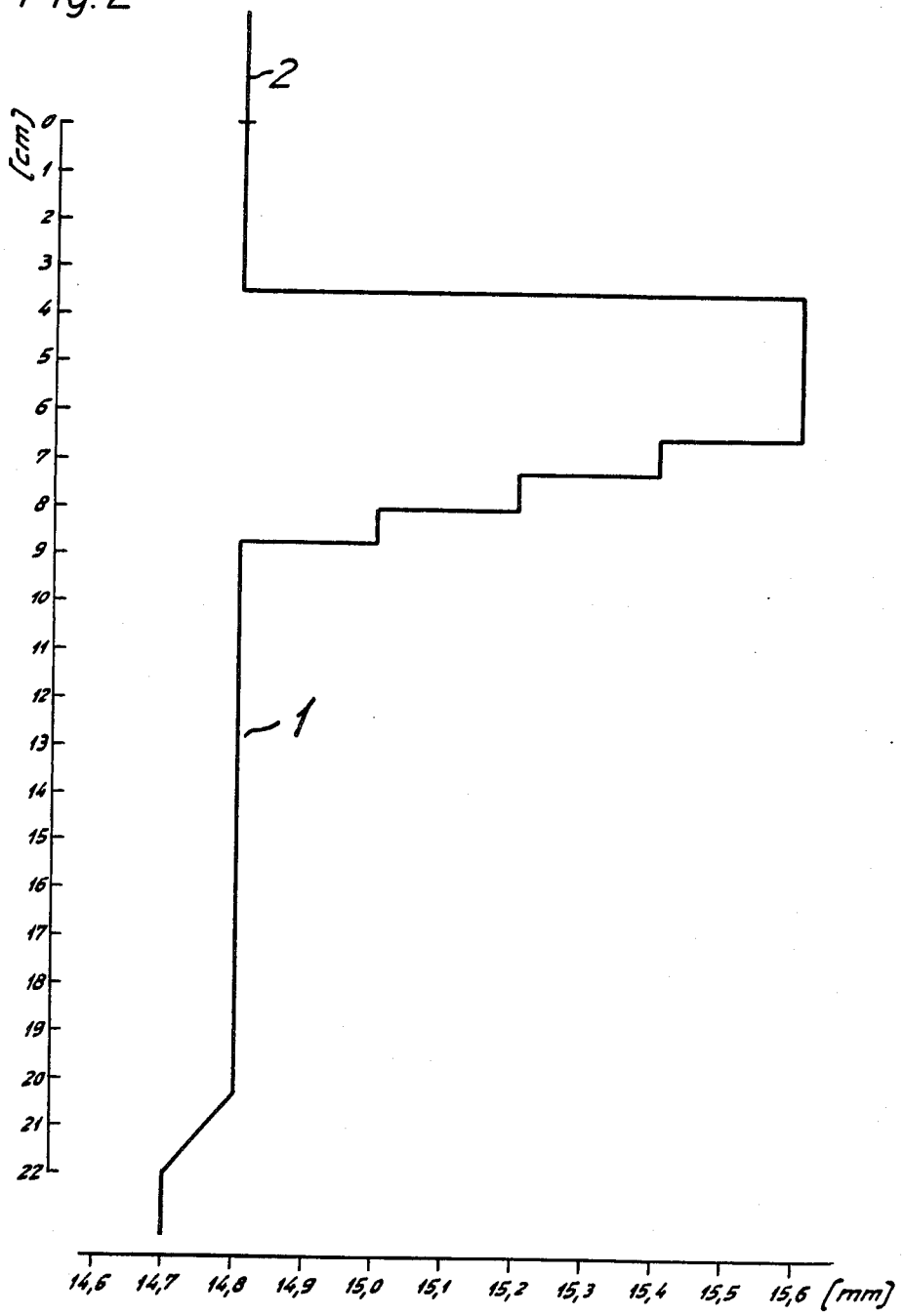
FIG. 2 shows the longitudinal sectional form of the upper body of a B-flat clarinet, only the right-hand contour being illustrated.

The enlargement of the bore diameter by 8/10 mm in the zone between the sections 8 and 3.5 is a recommended guide value which brings very good results for most clarinets. Refinements must be determined experimentally from case to case. Of course, the size and arrangement of the tone holes plays a great role in this. The embodiment of the enlargement between sections 8 and 3.5 as shown in FIG. 1, i.e. with an abruptly changing diameter, is not of extreme significance; as shown in FIG. 2, several recesses may be provided. In that diagram, the first recess starts at section 9 and the enlargement is complete at section 3.5. This example shows that, when several recesses are disposed in series, the preferred starting section can be displaced downwardly, from section 10 toward section 12 without incurring substantially worse results. However, the experiments that were conducted have shown that the most favorable results were obtained when the enlargement was located between the sections 8 and 3. A person skilled in the art recognizes, however, that when these limits are exceeded in either direction, the results obtained do not deteriorate abruptly. The deterioration takes place only gradually and depends on the magnitude of the deviation of the enlargement from its preferred position between sections 12 and 2.

The bore between sections 0 and 3.5 and sections 9 and 20.5 shown in FIG. 2 has a base diameter of 14.80 mm, the first recess has a diameter of 15.00, the second recess has a diameter of 15.20, the third recess has a diameter of 15.40 and the largest diameter of the enlargement is 15.60 mm. In the longitudinal direction, the recesses have the extent of one section, i.e., 1 cm. The cylindrical bore having the diameter 14.80 is maintained substantially up to the end of the upper clarinet body. The bore of the tenon of the upper clarinet body varies in diameter from 14.8 mm at section 20.5 to 14.7 mm at section 22. The bore of the lower clarinet body begins after the mortise at section 22 and has a diameter of 14.7 mm from section 22 to at least section 26.

In the embodiment of FIG. 1 and FIG. 2, the barrel has the same diameter as the bore between section 0 and section 3.5. This provision is not absolutely necessary. Rather, the barrel may have a greater or smaller diameter than the bore between sections 3.5 and 0. The narrowing which follows the big enlargement was placed immediately above the duodecimo sleeve, which is located at approximately section 3.5. This makes it possible to drill the upper clarinet body from the top, for example to section 8, with a diameter of 15.50 mm and to obtain the narrowing between sections 0 and 3.5 by inserting a plastic bushing having the corresponding diameters. The duodecimo sleeve is then located below the plastic bushing.

If the diameter of the bore between sections 3.5 and 0 or the bore of the barrel is greater than the diameter of the base bore, then it is suitable to reduce the diameter of the enlargement between sections 8 and 3.5 from the value 8/10 mm as shown to the values 6/10 to 7/10 mm in order to obtain the same good results. It may thus be assumed that when the diameter of the bore between sections 3.5 and 0 is larger than the base bore diameter by as much as approximately 5/100 to 30/100 mm, it is suitable to reduce the diameter of the enlargement between sections 8 and 3.5 by approximately 5/100 to 30/100 mm. The smaller the diameter of the bore between sections 8 and 3.5, the narrower may be the bore of the mouthpiece.

In another clarinet, not shown in the drawing, and equipped with a Leblanc tone hole pattern, a base bore of 14.80 mm diameter was chosen between sections 8 and 26. The enlargement between sections 8 and 3.5 was 15.35 mm. in diameter and the diameter of the bore between the sections 3.5 and 0 was made equal to 14.95 mm, i.e. 15/100 mm larger than the base bore diameter.

With these dimensions, a very good pure tuning of the duodecimos was achieved and the high-register tones were not too low.

Figure 3:
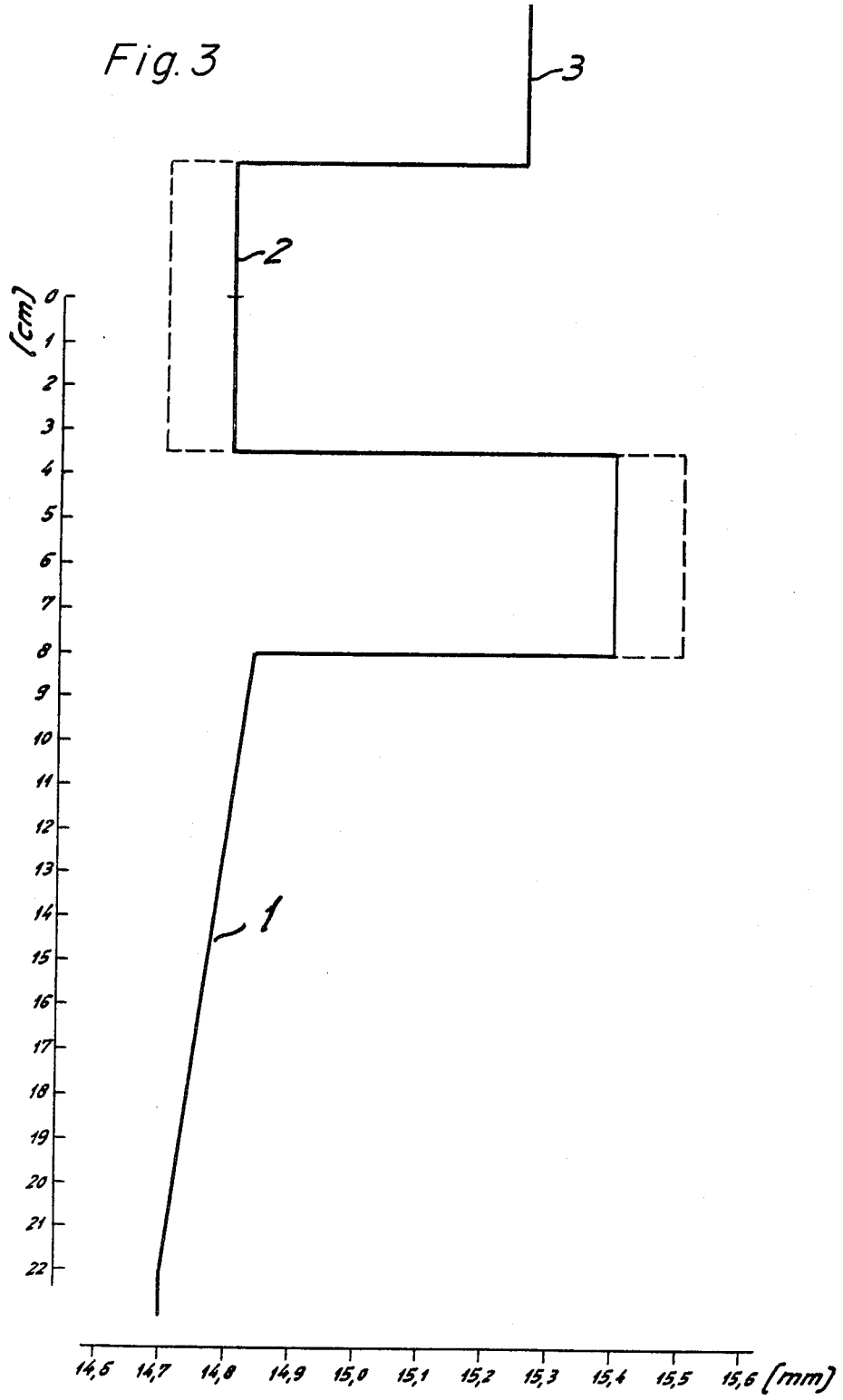
FIG. 3 shows a further, altered embodiment of the longitudinal bore of a B-flat clarinet from the mouthpiece up to and including the upper clarinet body, only the right-hand contour being illustrated.

If the bore is narrowed in the middle of the clarinet relative to the upper part, by one or more cylindrical narrowings or by a conical bore as shown in FIG. 3, then the enlargement in the zone between sections 8 and 3.5 may be smaller. In the longitudinal bore shown in FIG. 3, the diameter at the lower end of the upper clarinet body, i.e. at the section 22, is 14.70 mm and experiences an enlargement to a diameter of 14.84 mm at section 8. In the zone between sections 8 and 3.5, the enlargement is 15.40 mm while the diameter of the bore between sections 3.5 and 0 and the diameter of the barrel bore are both 14.80 mm. The cylindrical mouthpiece has a bore diameter of 15.25 mm. In this example, the bore above the enlargement, i.e. the zone between section 3.5 and the mouthpiece, may also be narrowed to the dimension of the base bore, i.e. to a diameter of 14.70 mm, as shown in dashed lines. In that case, it is recommended to increase the enlargement in the zone between sections 8 and 3.5 again somewhat, so that this enlarged bore then has a diameter of 15.50 mm (as shown by dashed lines in FIG. 3). The barrel bore should also be enlarged in the direction of the mouthpiece if the bore of the mouthpiece is narrower than shown.

A person skilled in the art knows that there are some mouthpieces which have a narrowing effect on the duodecimos and others which result in a widening of the duodecimos. For this reason, the size of the bore of the mouthpiece may be between 14.70 and approximately 15.25 mm, possibly more, when the longitudinal bore has the contour shown in FIG. 3.

Figure 4:
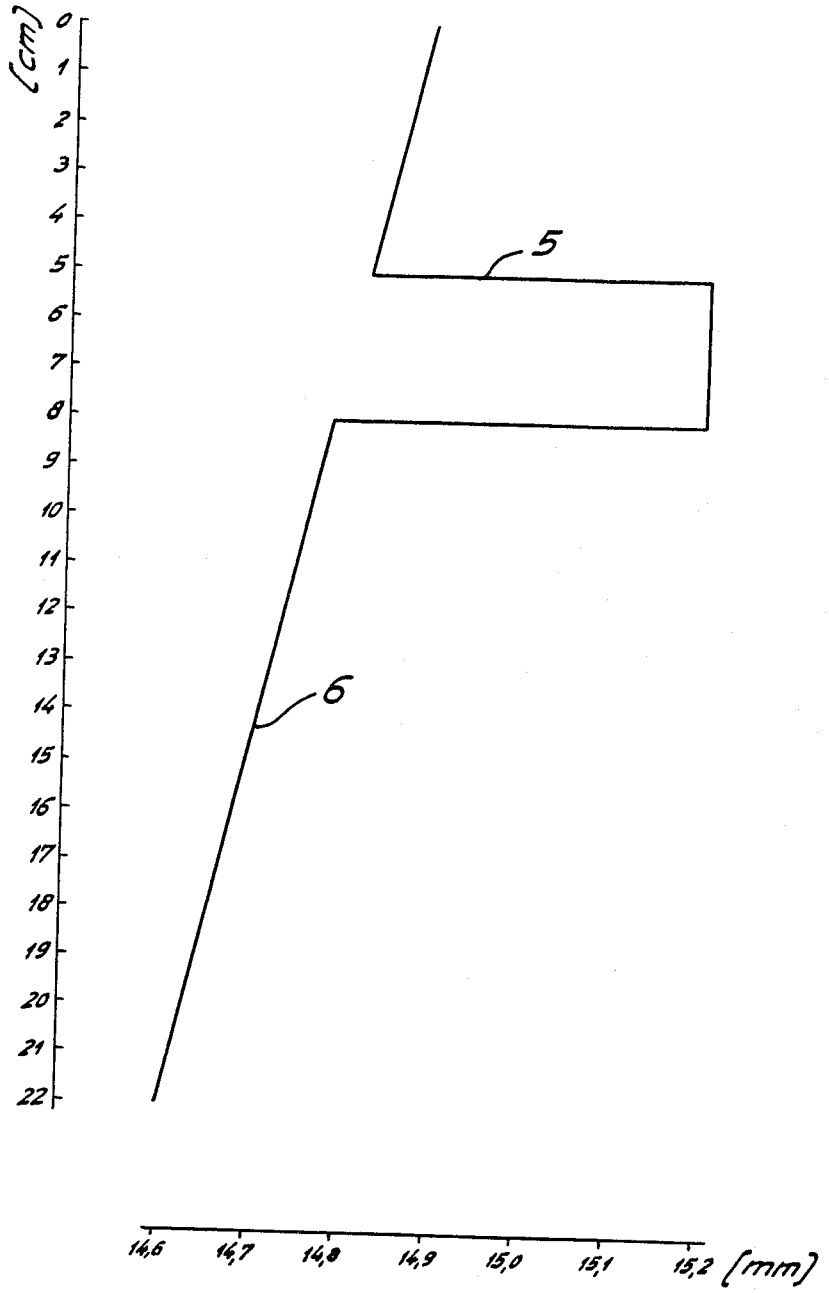
FIG. 4 shows an alternative embodiment of the upper clarinet body of a B-flat clarinet, only the right-hand contour being illustrated.
Figure 5:
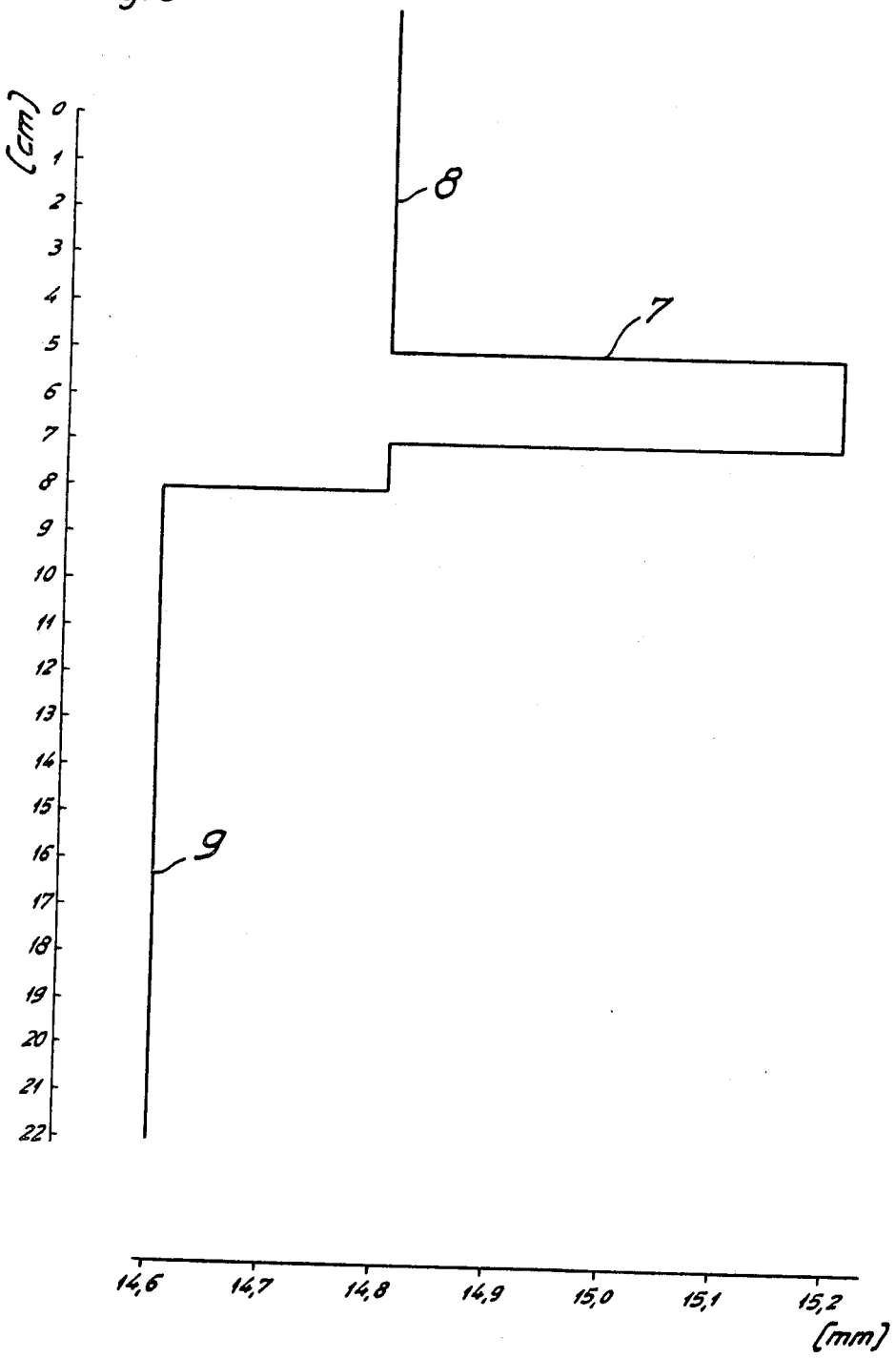
FIG. 5 shows an alternative embodiment of the upper clarinet body of a B-flat clarinet, only the right-hand contour being illustrated.

FIGS. 4 and 5 show that the enlargements formed by abrupt recesses need not be present only in a cylindrical longitudinal bore but may be provided in a conically increasing longitudinal bore 6 as an enlargement 5. FIG. 5 shows one possible embodiment in which the enlargement 7 of the upper clarinet body is placed after a relatively great narrowing so that bore 8 above the enlargement 7 is substantially wider than the bore 9 located below the enlargement, but even here, the basic principle of the invention, namely that the bores immediately adjacent to the enlargement be narrower than the enlargement itself, is obeyed.

Figure 6:
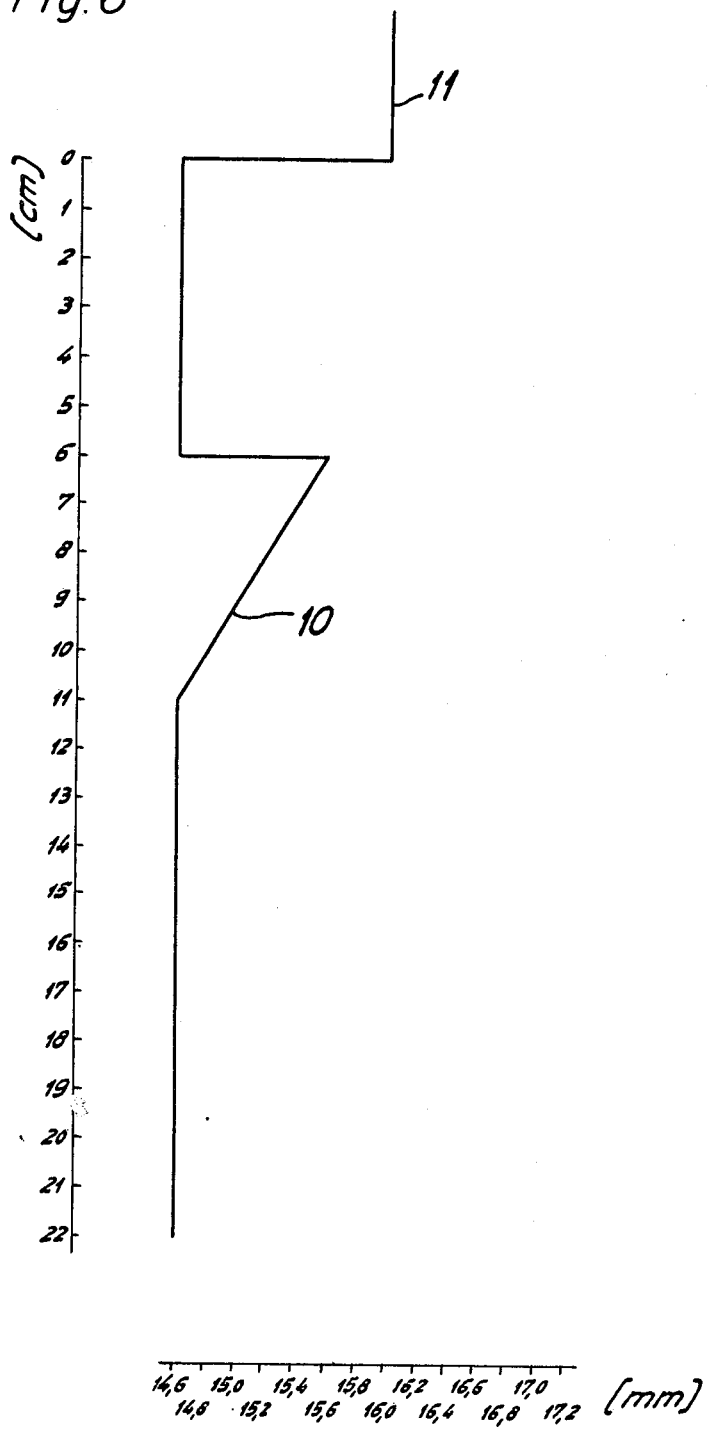
FIG. 6 shows an alternative embodiment of the upper clarinet body of a B-flat clarinet, only the right-hand contour being illustrated.

FIG. 6 shows an enlargement 10 which increases conically toward the barrel bore 11 and is located between sections 11 and 6, an abrupt narrowing taking place in section 6 to the bore diameter which prevails below the enlargement 10.

Figure 7:
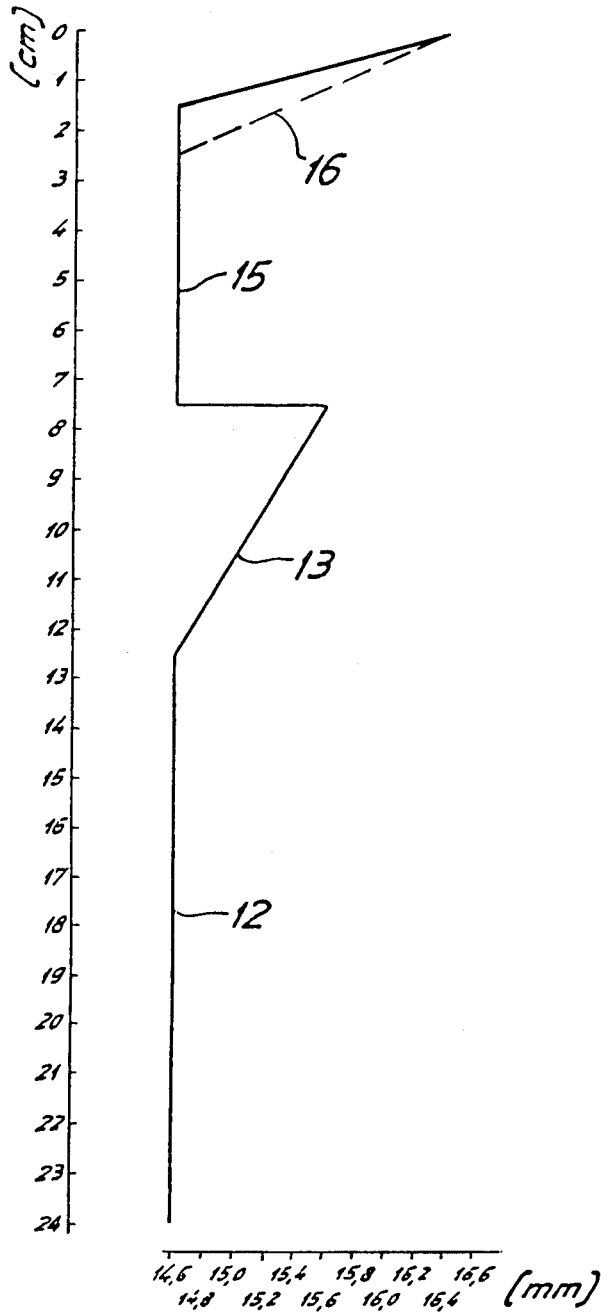
FIG. 7 shows an alternative embodiment of the upper clarinet body of an A-clarinet, only the right-hand contour being illustrated.
Figure 8:
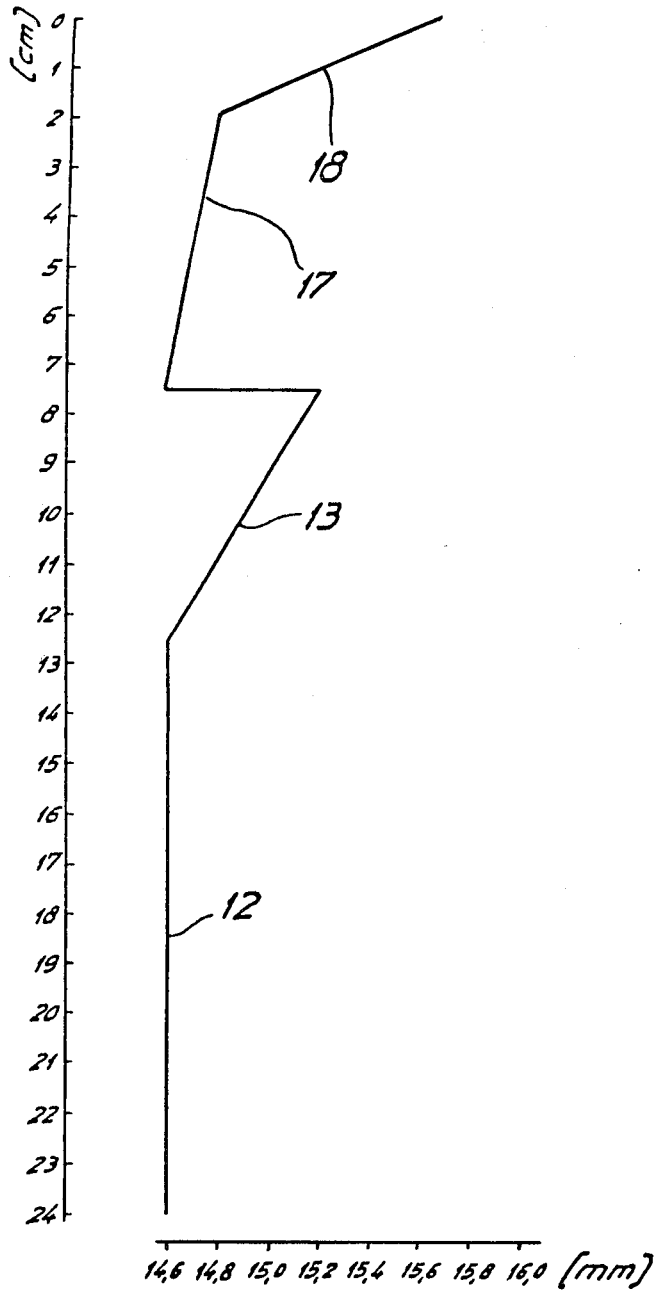
FIG. 8 shows an alternative embodiment of the upper clarinet body of an A-clarinet, only the right-hand contour being illustrated.
Figure 9:
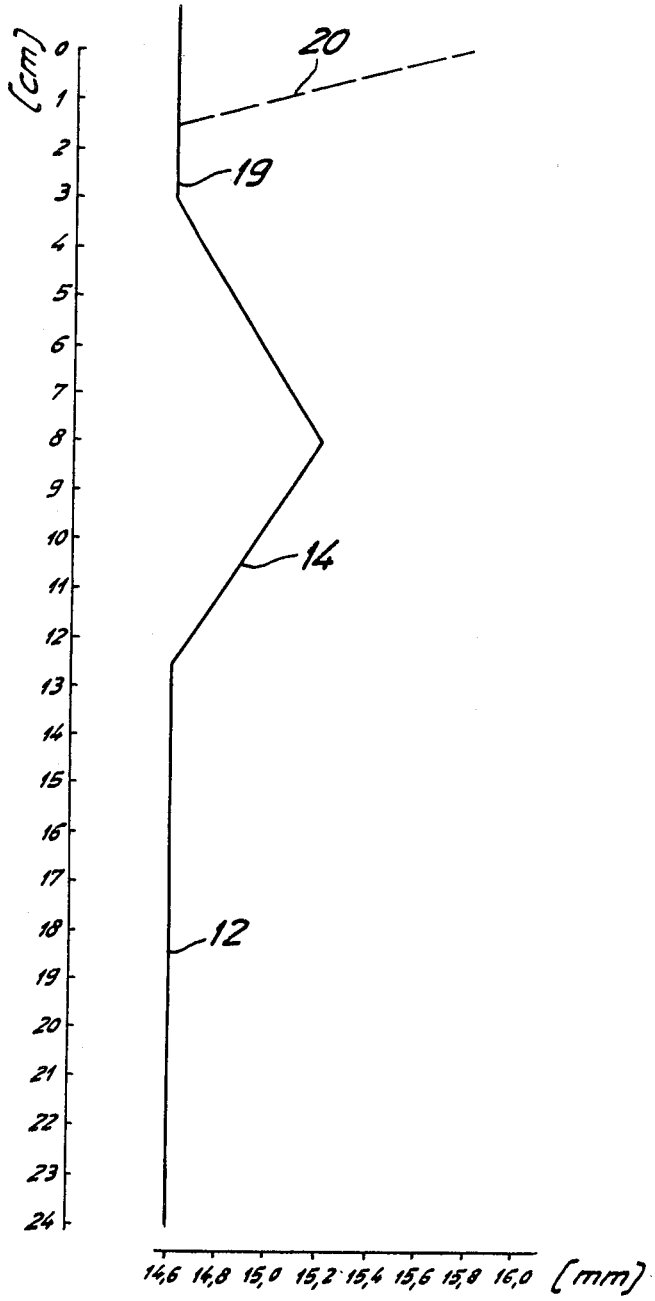
FIG. 9 shows an alternative embodiment of the upper clarinet body of an A-clarinet, only the right-hand contour being illustrated.

FIGS. 7–9 show cross-sectional representations of the upper body of A-clarinets. In these clarinets, the bore 12 extends from section 12.5 to section 24 and has a cylindrical shape with diameter equal to the diameter of the base bore. According to the invention, the enlargements 13 in FIGS. 7 and 8 and enlargement 14 in FIG. 9 all start at section 12.5. The enlargements according to FIGS. 7 and 8 extend to section 7.5 where an abrupt narrowing is located. The enlargement according to FIG. 9 extends to section 3, with the maximum enlargement occurring at section 8.

The embodiment of FIG. 7 shows an enlargement 13, followed by a bore 15 extending up to section 1.5 and having the same diameter as bore 12. The bore between section 1.5 and section 0 is very abruptly opened at right angles where the barrel bore (not shown) of narrower diameter follows. It is also possible, however, to let the upper enlargement start at section 2.5 followed by a sharp conical enlargement, as indicated by the dashed line 16. The diameter of the barrel bore depends on the bore enlargement in the zone between sections 2.5 and 0 and is narrower, the greater this enlargement is.

In the embodiment of FIG. 8, the enlargement 13 is followed after the narrowing at section 7.5 by a conical enlargement 17 which entends to section 2, followed in turn by a very abrupt enlargement 18 which is conical and extends up to the barrel.

In the embodiment of FIG. 9, the enlargement 14 is conically increased between section 12.5 and section 8 and then conically narrowed again between section 8 and up to section 3. From section 3 to section 0, the bore 19 has a diameter equal to the diameter of bore 12 (i.e. the diameter of the base bore). The dashed line 20 indicates the possibility of providing a sharply conical enlargement from section 1.5 to the barrel.

I claim:

1. A clarinet comprising variable diameter sections of a mouthpiece, a barrel, an upper clarinet body, a lower clarinet body, and a bell, with a longitudinal bore extending therethrough, and wherein (a) said longitudinal bore of said upper clarinet body comprises an enlarged portion, a first narrower portion extending from the top of said enlarged portion to the top of said upper clarinet body, and a second narrower portion extending from the bottom of said upper clarinet body to the bottom of said enlarged portion;

(b) said upper clarinet body having an individual unit consisting of at least 22 theoretical consecutively numbered sections of equal length from the top of said upper clarinet body;

(c) said enlarged portion being located anywhere in a zone ranging between sections 14 to 2, and formed by an increase in the diameter of said longitudinal bore;

the diameter at the narrowest point of said longitudinal bore of said upper clarinet body defining a theoretical, cylindrical base bore of equal diameter.

2. A clarinet as in claim 1, wherein said enlargement corresponds to an increase in volume of 300 to 3000 $mm^3$, relative to said base bore.

3. A clarinet as in claim 1, wherein when the first narrower portion has a larger diameter than the diameter of said base bore, then the diameter of said enlarged portion is smaller than is the case when said first narrower portion has a diameter equal to the diameter of said base bore.

4. A clarinet as in claim 1, wherein the diameter of said longitudinal bore extending from a point located between 4 and 1 to the top of said upper clarinet body is enlarged by 8/10 to 20/10 mm, relative to the diameter of said base bore.

5. A clarinet as in claim 1, wherein said lower clarinet body is an indivisible unit consisting of said theoretical consecutively numbered sections of equal length from the top of said upper clarinet body, and said longitudinal bore of said lower clarinet body comprises a conical portion that enlarges its diameter toward said bell, at a rate of 8/100 mm per section starting at a point lying in the sixth, seventh, or eighth section from the top of said lower clarinet body and extending to said bell.

6. A clarinet as in claim 1, wherein said barrel bore is conically enlarged in the direction of said mouthpiece by 2/10 to 20/10 mm, preferably by 2/10 to 8/10, relative to the diameters of said base bore.

7. A clarinet as in claim 1, wherein the diameter of said mouthpiece bore is 5/10 to 20/10 mm, preferably 5/10 to 8/10 mm, larger than the diameter of said base bore.

8. A clarinet as in claim 1, wherein the said enlarged portion corresponds to an increase in diameter of 4/10 to 20/10 mm, relative to said base bore.

9. A clarinet as in claim 1, wherein said enlarged portion of said longitudinal bore is preferably provided between sections 10 and 4.5.

10. A clarinet as in claim 1, wherein the diameter of said first narrower portion is equal to the diameter of said base bore.

11. A clarinet as in claim 1, wherein the diameter of said first narrower portion is greater than the diameter of said base bore by 1/10 to 3/10 mm.

12. A clarinet as in claim 1, wherein said enlarged portion is preferably situated between sections 12.5 and 7.5.

13. A clarinet as in claim 1, wherein the length of said barrel is tuned to a basic pitch of a'/440.

* * * * *